US008301513B1

(12) United States Patent
Peng et al.

(10) Patent No.: US 8,301,513 B1
(45) Date of Patent: Oct. 30, 2012

(54) SYSTEM, METHOD, AND COMPUTER READABLE MEDIUM FOR DYNAMICALLY PRICING AN ITEM BASED ON SERVICE PLAN SELECTION

(75) Inventors: Shih-Ta Peng, Bellevue, WA (US); Charles Steven Johnson, Snohomish, WA (US); Aaron C. Rubenson, Seattle, WA (US); Gregor Alan Moulton, Austin, TX (US)

(73) Assignee: Amazon Technologies, Inc., Reno, NV (US)

( * ) Notice: Subject to any disclaimer, the term of this patent is extended or adjusted under 35 U.S.C. 154(b) by 250 days.

(21) Appl. No.: 12/787,043

(22) Filed: May 25, 2010

(51) Int. Cl.
*G06Q 30/00* (2012.01)

(52) U.S. Cl. ..... 705/26.61; 705/26.1; 705/26.5; 705/26.62; 705/26.63; 705/26.64; 705/26.8; 705/27.1

(58) Field of Classification Search ..... 705/26.1–27.2
See application file for complete search history.

(56) References Cited

U.S. PATENT DOCUMENTS 6,167,383 A * 12/2000 Henson ..... 705/26.5
2006/0224469 A1* 10/2006 Kunz et al. ..... 705/27
2009/0089165 A1* 4/2009 Sweeney ..... 705/14
2009/0204508 A1* 8/2009 Podgurny et al. ..... 705/26
2010/0042510 A1* 2/2010 Zeinfeld et al. ..... 705/26
2010/0223159 A1* 9/2010 MacKay et al. ..... 705/27
2011/0137745 A1* 6/2011 Goad et al. ..... 705/26.9

OTHER PUBLICATIONS www.letstalk.com Mar. 4, 2009. [recovered from www.Archive.org].*

* cited by examiner

*Primary Examiner* — William Allen
(74) *Attorney, Agent, or Firm* — Thomas, Kayden, Horstemeyer & Risley, LLP

(57) ABSTRACT

Disclosed are various embodiments for providing dynamic item pricing to a customer during online shopping and/or purchasing of wireless devices. In a representative embodiment, a dynamic pricing system is executed in a computing device that generates a network page to send to a client device over a network, the network page including a price for a specified wireless device. The dynamic pricing system communicates with the client device over the network to obtain a selected service plan associated with the specified wireless device. The dynamic pricing system determines an updated price for the specified wireless device in response to the selected service plan for access by the customer.

16 Claims, 11 Drawing Sheets

SERVICE OPTIONS: 609

Total cost of selected service options: $30.00

Add to Cart

606

Choose from available service options for:
BlueBerry Slim 8000 Phone

Your Cart | ZIP code: 22222

✔ 1. Phone (1 selected)

BlueBerry Slim 8000 Phone

List Price: ~~$499.99~~
Price: $64.99

Remove from Cart

✔ 2. Plan (1 selected)

AT&T 900 Rollover

Price per month: $59.99

Remove from Cart

3. Service Options

Due Monthly: $59.99

Phone Price: $64.99

603

BlueBerry Services:

| | Price per Month |
|---|---|
| ● Personal – unlimited data | $30.00 |
| ○ Executive – unlimited data with corporate e-mail | $45.00 |
| ○ Executive Plus – unlimited data with corporate e-mail and laptop connectivity | $60.00 |

Text Messaging:

| | Price per Month |
|---|---|
| ● None – pay per use, from $0.20 per message | $0.00 |
| ○ Messaging Basic – 200 text, picture, and IM messages | $5.00 |
| ○ Messaging Extra – 1500 text, picture, and IM messages | $15.00 |
| ○ Messaging Unlimited – unlimited text, picture, and IM messages | $20.00 |

Additional Services:

| | Price per Month |
|---|---|
| ○ Voice Mail Extra – holds twice the messages (50) | $1.99 |
| ○ Roadside Assistance – toll-free support, 24-hours a day | $2.99 |
| ○ Voice Dialing – hands free dialing | $4.99 |
| ○ Remote Parental Controls | $4.99 |
| ○ Extended Nights & Weekend Minutes | $8.99 |
| ○ International Long Distance Package | $9.99 |

126d

FIG. 6

SYSTEM, METHOD, AND COMPUTER READABLE MEDIUM FOR DYNAMICALLY PRICING AN ITEM BASED ON SERVICE PLAN SELECTION

BACKGROUND

The online purchase of wireless devices such as cellular telephones over the Internet is complicated by the number of devices and service plans that are available through a single web site. With increasing numbers of web sites offering wireless devices, device pricing has become an important consideration for customers in purchasing a device through a web site.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

FIGS. 2-6 depict examples of network pages generated in the networked environment of FIG. 1 according to various embodiments of the present disclosure.

DETAILED DESCRIPTION

In the following discussion, various systems and methods are described to provide dynamic item pricing to a customer during online shopping and/or purchasing of wireless devices. Pricing of a wireless device may be dynamically adjusted or updated based upon the selection of a service area, a service plan, and/or service options associated with a wireless device by a customer. In the following discussion, a general description of the system and its components is provided, followed by a discussion of the operation of the same.

Figure 1:
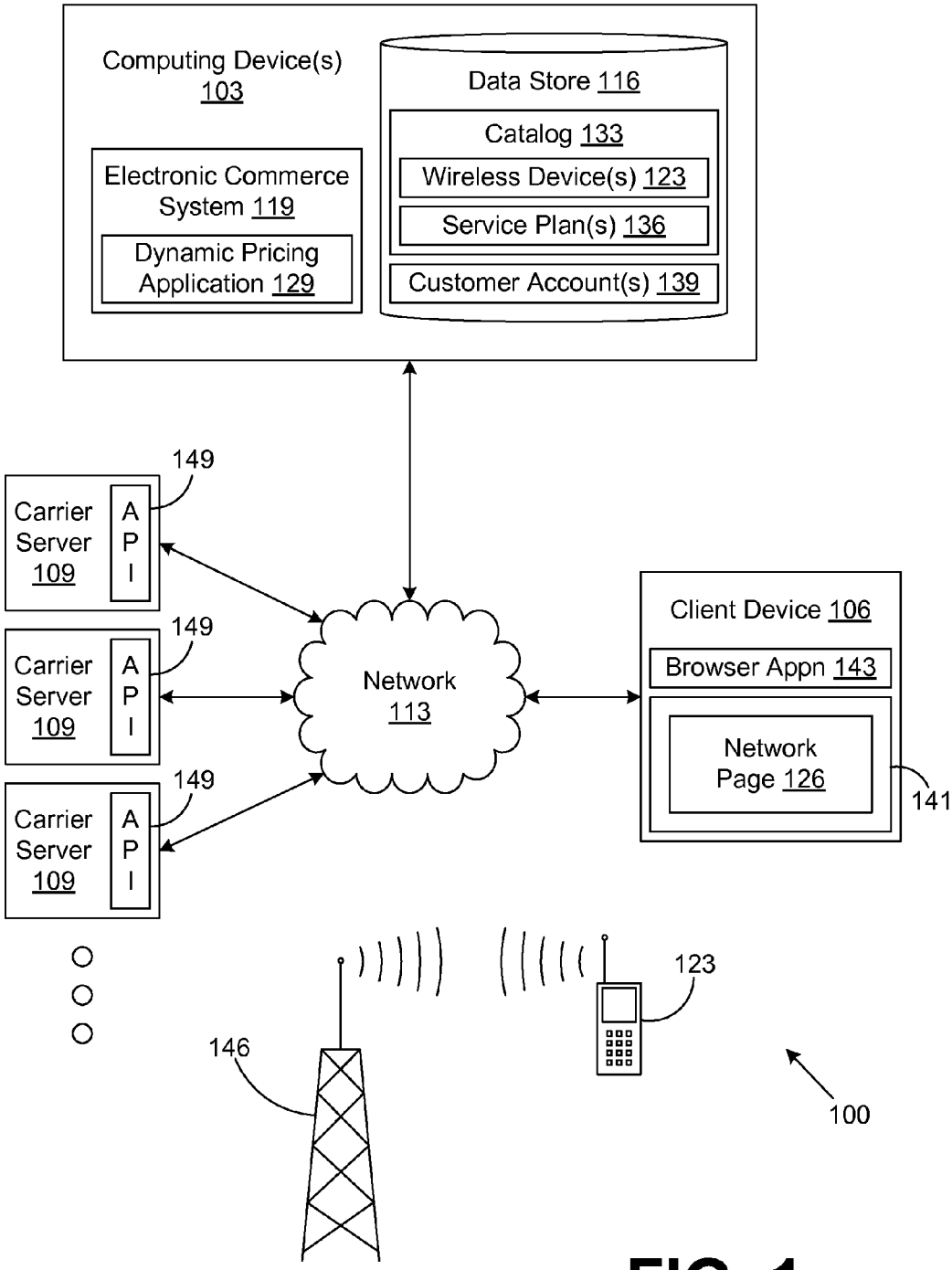
FIG. 1 is a drawing of a networked environment according to various embodiments of the present disclosure.

With reference to FIG. 1, shown is a networked environment 100 according to various embodiments. The networked environment 100 includes one or more computing devices 103, one or more client devices 106, and a plurality of carrier servers 109, each of which is coupled to a network 113. The network 113 includes, for example, the Internet, intranets, extranets, wide area networks (WANs), local area networks (LANs), wired networks, wireless networks, or other suitable networks, etc., or any combination of two or more such networks.

The computing device(s) 103 may comprise, for example, a server computer or any other system providing computing capability. Alternatively, a plurality of computing devices 103 may be employed that are arranged, for example, in one or more server banks or computer banks or other arrangements. For example, a plurality of computing devices 103 together may comprise, for example, a cloud computing resource, a grid computing resource, and/or any other distributed computing arrangement. Such computing devices 103 may be located in a single installation or may be dispersed among many different geographical locations. In one embodiment, the computing device 103 represents a virtualized computer system executing on one or more physical computing systems. For purposes of convenience, the computing device 103 is referred to herein in the singular. Even though the computing device 103 is referred to in the singular, it is understood that a plurality of computing devices 103 may be employed in the various arrangements as described above.

Various applications and/or other functionality may be executed in the computing device 103 according to various embodiments. Also, various data is stored in a data store 116 that is accessible to the computing device 103. The data store 116 may be representative of a plurality of data stores 116 as can be appreciated. The data stored in the data store 116, for example, is associated with the operation of the various applications and/or functional entities described below.

The components executed on the computing device 103 include, for example, an electronic commerce system 119 and other systems, applications, services, processes, engines, or functionality not discussed in detail herein. The electronic commerce system 119 is executed in order to facilitate the online purchase of items such as, for example, wireless devices 123 over the network 113. Such wireless devices 123 may comprise, for example, personal digital assistants (PDA), cellular telephones, computers, cellular adapters for computers, and other devices. However, it is understood that the electronic commerce system 119 may ultimately facilitate the purchase any type of item, including other devices that utilize a service plan provided by a service carrier. The electronic commerce system 119 also performs various backend functions associated with the online presence of a merchant in order to facilitate the online purchase of items as will be described. For example, the electronic commerce system 119 generates network pages 126 such as web pages or other types of network content that are provided to client devices 106 in response to requests for the purposes of selecting items for purchase, rental, download, lease, or other form of consumption and to perform other tasks as will be described. Among other applications, the electronic commerce system 119 includes a dynamic pricing application 129 that is executed in order to adjust pricing of a wireless device 123 dynamically as will be described. Dynamic pricing adjustment may also be applied to other devices that utilize a service plan 136 provided by a service carrier.

The data stored in the data store 116 includes, for example, a catalog 133 that includes a listing of various items such as, for example, wireless devices 123, and potentially other data. In addition, the catalog 133 includes a listing of service plans 136 that may be sold in association with respective ones of the wireless devices 123. The service plans 136 are offered by various service carriers. For example, a service plan 136 may involve wireless service for a wireless device. In one embodiment, a wireless device 123 may be sold in association with a given service plan 136 as a package deal as will be described. Alternatively, the wireless device 123 may be sold separately. Ultimately, once a wireless device 123 and a service plan 133 are sold, a customer may activate the wireless service for wireless device 123 through various network pages 126 or through contact with the carrier server 109.

Also stored in the data store 116 may be customer accounts 139 that include various information associated with customers that purchase items through the electronic commerce system 119. Such information may include customer names, shipping addresses, billing addresses, payment instruments, shopping carts, wish lists, previous wireless device 123 and service plan 136 purchases, and other information associated with customers as can be appreciated.

The client device 106 is representative of a plurality of client devices that may be coupled to the network 113. The client device 106 may comprise, for example, a processor-based system such as a computer system. Such a computer system may be embodied in the form of a desktop computer, a laptop computer, a personal digital assistant, a cellular telephone, set-top box, music players, web pads, tablet computer systems, or other devices with like capability. The client device 106 includes a display device 141 upon which various network pages 126 and other content may be rendered.

The client device 106 may be configured to execute various applications such as a browser application 143 and/or other applications. The browser application 143 may be executed in a client device 106, for example, to access and render network pages 126, such as web pages, or other network content served up by the computing device 103 and/or other servers. The client device 106 may be configured to execute applications beyond browser application 143 such as, for example, e-mail applications, instant message (IM) applications, and/or other applications.

In addition, each of the carrier servers 109 is operated by a service carrier (or provider) so as to provide service, for example, to a wireless device 123 in accordance with a service plan 136 purchased by the customer. Each carrier may operate, for example, a wireless network 146 to provide wireless service to the wireless device 123. Each carrier maintains an application programming interface (API) 149 to facilitate communication with outside entities who sell service plans 136 of the respective carrier. Once a service plan 136 associated with a given service carrier (or provider) is sold, then the corresponding carrier server 109 activates the service for the purchased wireless device 123.

Next, a general description of an example of the operation of the various components of the networked environment 100 is provided. To begin, a customer (or client) may have an interest in purchasing a wireless device 123 through the electronic commerce system 119 as described above. As a result, the customer may send an initiating request from a client device 106 to the electronic commerce system 119 to obtain a listing of wireless devices 123 that are available for purchase through the electronic commerce system 119. In some cases, the initiating request may be result of a search query for a specific wireless device 123 or service plan 136.

One or more network pages 126 may be served up to the client device 106 associated with a respective customer to provide a listing of wireless devices 123 (e.g., cellular telephones and PDAs) offered through the electronic commerce system 119. Such network pages 126 may include various components that may be manipulated by the customer causing a message to be sent back to the electronic commerce system 119 indicating customer selections regarding wireless devices 123, wireless service plans 136, and/or service options to be included in an online purchase. For example, in response to the initiating request, the electronic commerce system 119 may generate a preliminary network page 126 that includes a listing of one or more cellular telephones offered through the electronic commerce system 119 and a component that facilitates selection of a cellular telephone.

If the customer is interested in a listed wireless device 123, the customer (or client) selects the wireless device 123 and the client device 106 provides an indication of the selected wireless device 123 to the electronic commerce system 119. In some embodiments, the customer may select more than one wireless device 123. In response to the selection of the wireless device 123, the electronic commerce system 119 generates a network page 126 including a price for the selected wireless device 123 as well as other information related to the selected wireless device 123. The network page 126 is then served up to the client device 106 associated with a respective customer for rendering.

Figure 2:
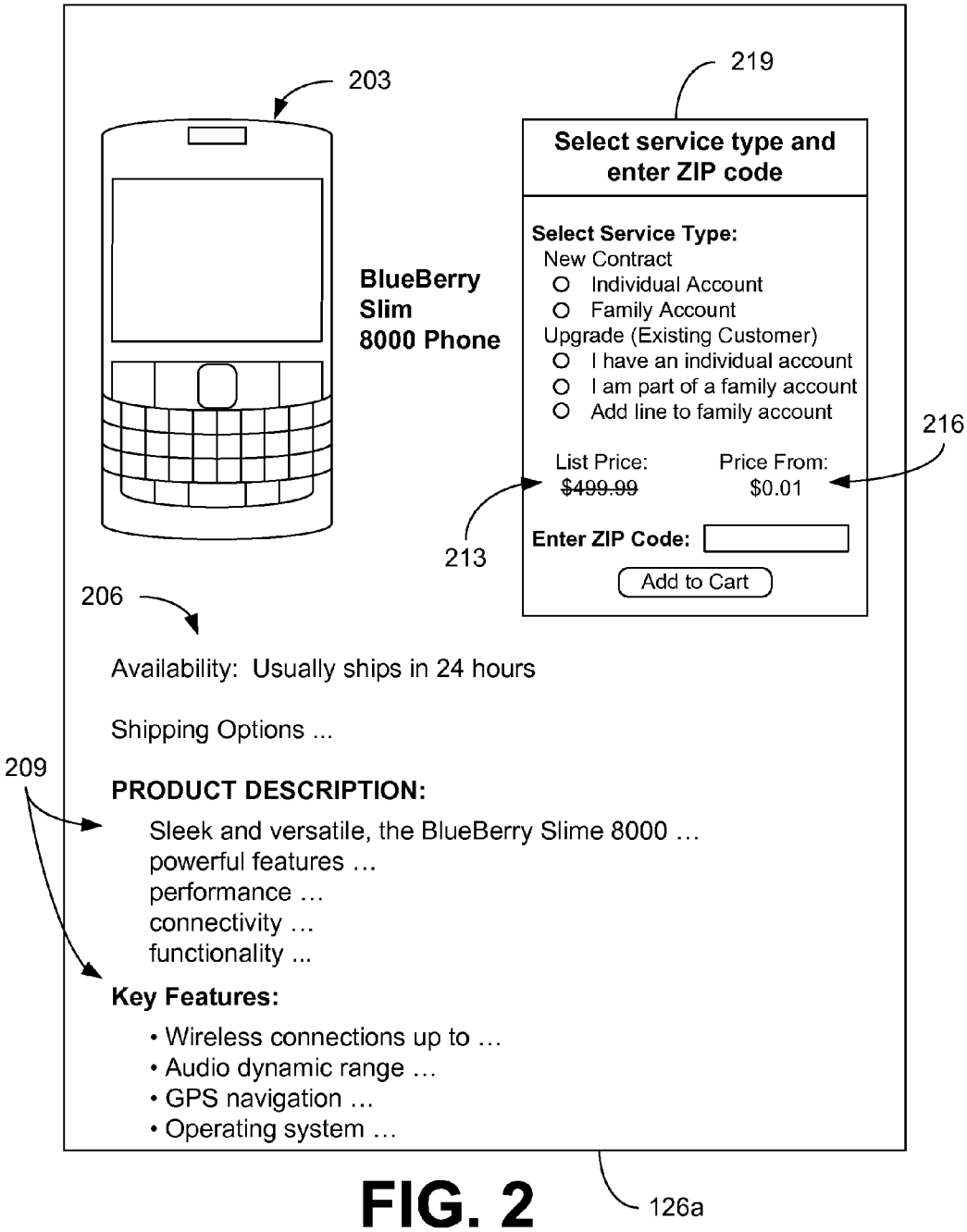

FIG. 2 provides an example of a network page **126*a* generated by the electronic commerce system 119 (FIG. 1) in response to the selection of a wireless device 123 (FIG. 1) by the customer (or client). In the exemplary embodiment of FIG. 2, the network page 126*a* has various information regarding the selected wireless device 123 such as, but not limited to, a picture of the device 203, availability information 206, product description and key features 209, and a list price 213. In many cases, commissions (or credits) are provided to the electronic commerce system 119 by the service carriers (or providers) based, for example, upon the service type and/or service plan 136 (FIG. 1) associated with a wireless device 123 that is purchased through the electronic commerce system 119. To promote sales, a portion of the commission may be applied by the electronic commerce system 119 to adjust the purchase price of the selected wireless device 123** based upon the customer's selections.

To provide this information to a potential customer, the network page **126*a* of FIG. 2 includes a price 216 that is offered by the electronic commerce system 119 for the selected wireless device 123. In the example of FIG. 2, the minimum offer price 216 available through the electronic commerce system 119 is indicated. Price 216 may be dynamically adjusted based upon the service type, service plan 136, and/or service options selected by the customer. A component 219 to facilitate selection, by the customer, of a service type associated with the selected wireless device 123 may be included in the network page 126*a*. In the embodiment of FIG. 2, the component 219** includes options for new and existing contracts corresponding to individual or family accounts. Other embodiments may provide for different service types and/or transactions.

In the example of FIG. 2, the customer selects a service type through component 219 of network page **126*a*. For instance, the customer may wish to purchase a replacement wireless device 123 because of an accident or another reason. If the customer has an existing wireless contract, the customer may select an option under "Existing Customer" as illustrated by selection 223 of FIG. 3. If the customer does not have an existing contract for wireless service, the customer may select an option under "New Contract." The selected service type is sent to the electronic commerce system 119 where the dynamic pricing application 129 (FIG. 1) receives the information. In other embodiments, current customer service plan information may be available through a customer account 139 (FIG. 1) or on client device 106 (FIG. 1). Component 219 may designate a service type based upon the current customer service plan information. The customer may then use component 219** to change the selection as desired.

In response to the selected service type, the dynamic pricing application 129 determines an adjusted or updated price based, for example, upon the wireless device 123 and the selected service type. In some embodiments, the updated price may be determined using one or more lookup tables. For example, the wireless device 123 may have a base price that is adjusted based upon customer selections. The adjustment value may be an adder (positive adjustment) or discount (negative adjustment) determined from a lookup table based upon the selected service type and added to, or subtracted from, the base price to determine the updated price for the wireless device 123. Alternatively, the updated price may be obtained directly from a lookup table based upon the wireless device 123 and the selected service type.

Figure 3:
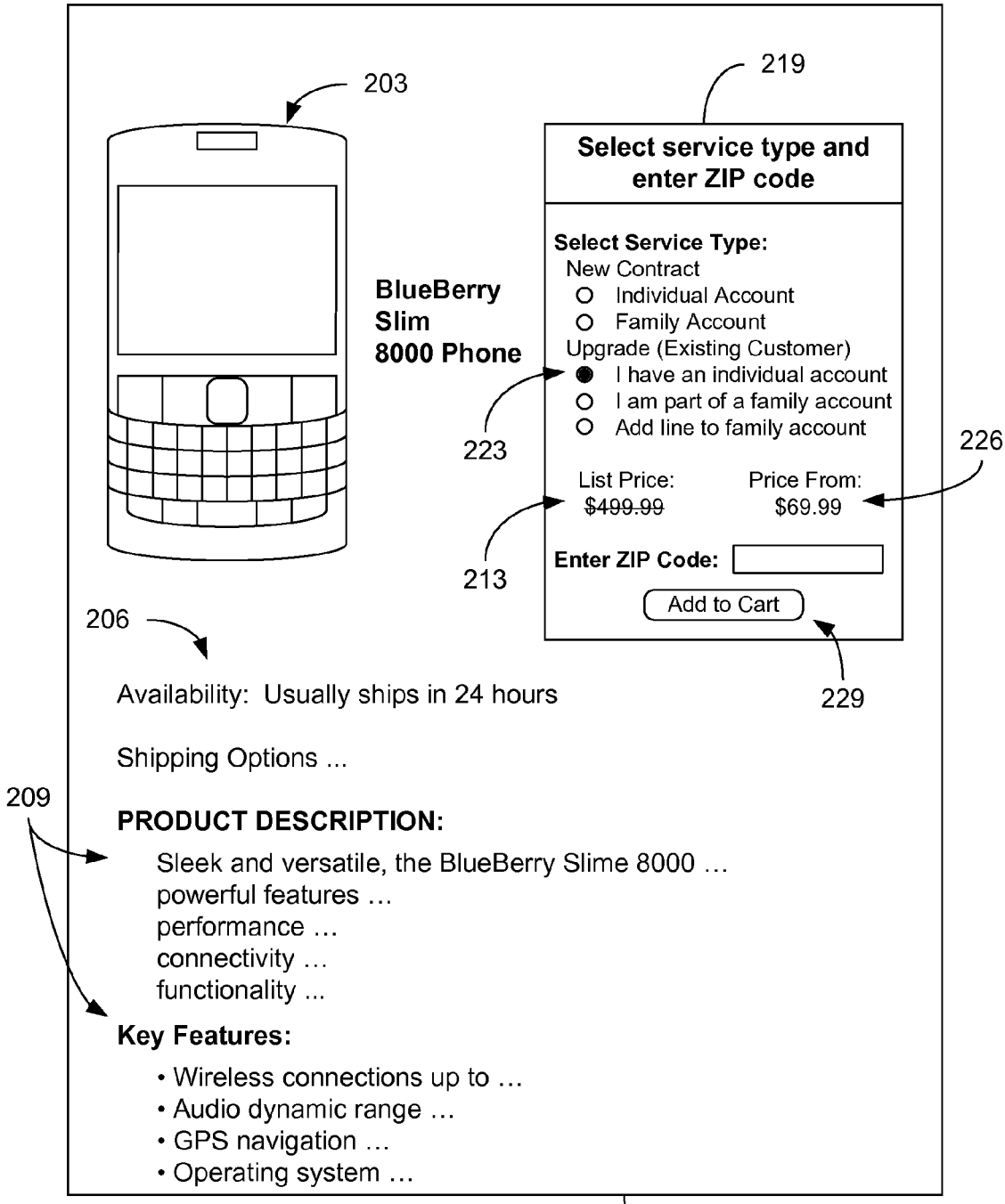

The updated price is then provided to the client device 106 by the dynamic pricing application 129 of the electronic commerce system 119. In one embodiment, the updated price is provided to a browser application 143 to update the network page 126*a*. In another embodiment, a new network page 126*b* including the updated price is provided to the client device 106 for rendering as illustrated in FIG. 3. As depicted in FIG. 3, price 216 of FIG. 2 has been dynamically adjusted based upon the selected service type and displayed as updated price 226. In some embodiments, the selected service type may not affect the price 216 of the wireless device, causing the updated price 226 to remain the same as the original price 216.

Component 219 of network pages 126*a* and 126*b* may also obtain information corresponding to a service area associated with the service contract such as, but not limited to, a postal code (e.g., a zip code), an area code, or an existing telephone number. In the embodiments of FIGS. 2 and 3, component 219 facilitates the collection of a zip code. Availability of wireless providers, service plans 136, and service options associated with the selected wireless device 123 may be restricted by the identified service area, thereby affecting the updated price 226 for the wireless device 123.

In some embodiments, a plurality of selected wireless devices 123 and their corresponding prices may be displayed in a single network page 126. Selection of a service type by the customer may cause one or more of the corresponding prices to be updated as described above, allowing the customer to compare prices between different wireless devices 123 on a single network page 126. Additionally, specifying a zip code or other area designation may affect the pricing of some or all of the plurality of wireless devices 123. In some cases, one or more wireless devices may be eliminated from the network page 126 because service plans 136 are not available in the identified area.

The customer may then proceed with the purchasing process by requesting that the selected wireless device 123 be added to a shopping cart using icon 229. In the case of a plurality of selected wireless devices 123, the customer may indicate that a specific wireless device 123 is to be added to the cart. In response to the request of the customer, the electronic commerce system 119 generates a new network page 126 for selection of a service plan 136 associated with the selected wireless device 123.

Figure 4:
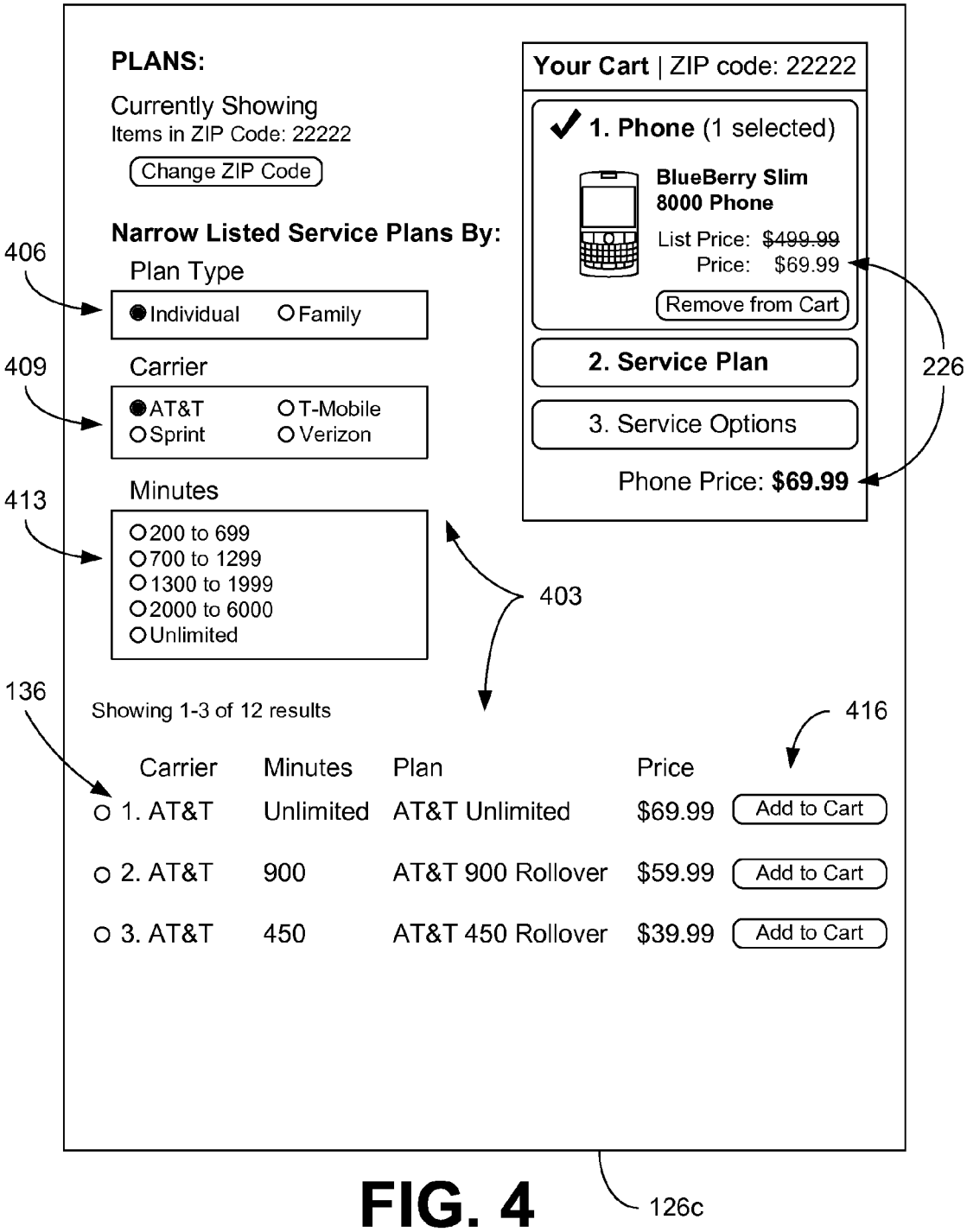

Referring next to FIG. 4, shown is an example of a service plan network page 126*c* generated in response to the customer request. The service plan network page 126*c* includes an indication of the selected wireless device 123, the updated price 226, and a component 403 that facilitates selection of a service plan 136 associated with the selected wireless device 123. In some embodiments, all available service plans 136 are presented in the network page. Alternatively, the service plans 136 may be filtered or restricted to reduce the number of presented service plans 136. For example, in the exemplary embodiment of FIG. 4, component 403 includes display options to limit the presented service plans 136 by plan type 406, service carrier 409, and/or plan minutes 413. As can be understood, other display options may be used as appropriate.

In FIG. 4, three service plans 136 are presented based at least in part upon the selected display options 406 and 409. In one embodiment, a service plan 136 may be selected by the customer and sent to the electronic commerce system 119 (FIG. 1). Upon receiving the service plan selection, the dynamic pricing application 129 (FIG. 1) further adjusts the price of the selected wireless device 123 (FIG. 1) and returns the further updated price to the client device 106 (FIG. 1). In some embodiments, the updated price 226 of network page 126*c* is replaced with the further updated (or adjusted) price. Alternatively, a new network page 126 may be provided with the further updated price. In other embodiments, the updated price 226 is not adjusted until after the selected service plan 136 is added to the cart using icons 416.

The updated price for the selected wireless device 123 may be further adjusted based, for example, upon the wireless device 123, service type, and/or selected service plan 136 using a lookup table and an adjustment value as discussed above. The adjustment value may be an adder (positive adjustment) or discount (negative adjustment) determined from a lookup table based upon the selected service plan 136 and added to or subtracted from the base price to determine the updated price for the wireless device 123. Alternatively, the price of the selected wireless device 123 may be adjusted based upon, e.g., a percentage of the commission provided by the service carrier (or provider) for the selected service plan 136, a percentage of the monthly cost of the selected service plan 136, a percentage of the total cost of the selected service plan 136 over the term of the contract, or based upon a fixed amount corresponding to the selected service plan 136. In some embodiments, the adjustment of the price may be tiered based upon the cost of the service plan 136. For example, service plans 136 above a predetermined amount (e.g., $49.99) may be adjusted by a first amount and service plans at or below the predetermined amount may be adjusted by a second amount or may not be adjusted at all. Additional tiers may be used as can be appreciated. The customer may then proceed with the purchasing process by requesting that the selected service plan 136 be added to the shopping cart including the selected wireless device 123 using icons 416.

Figure 5:
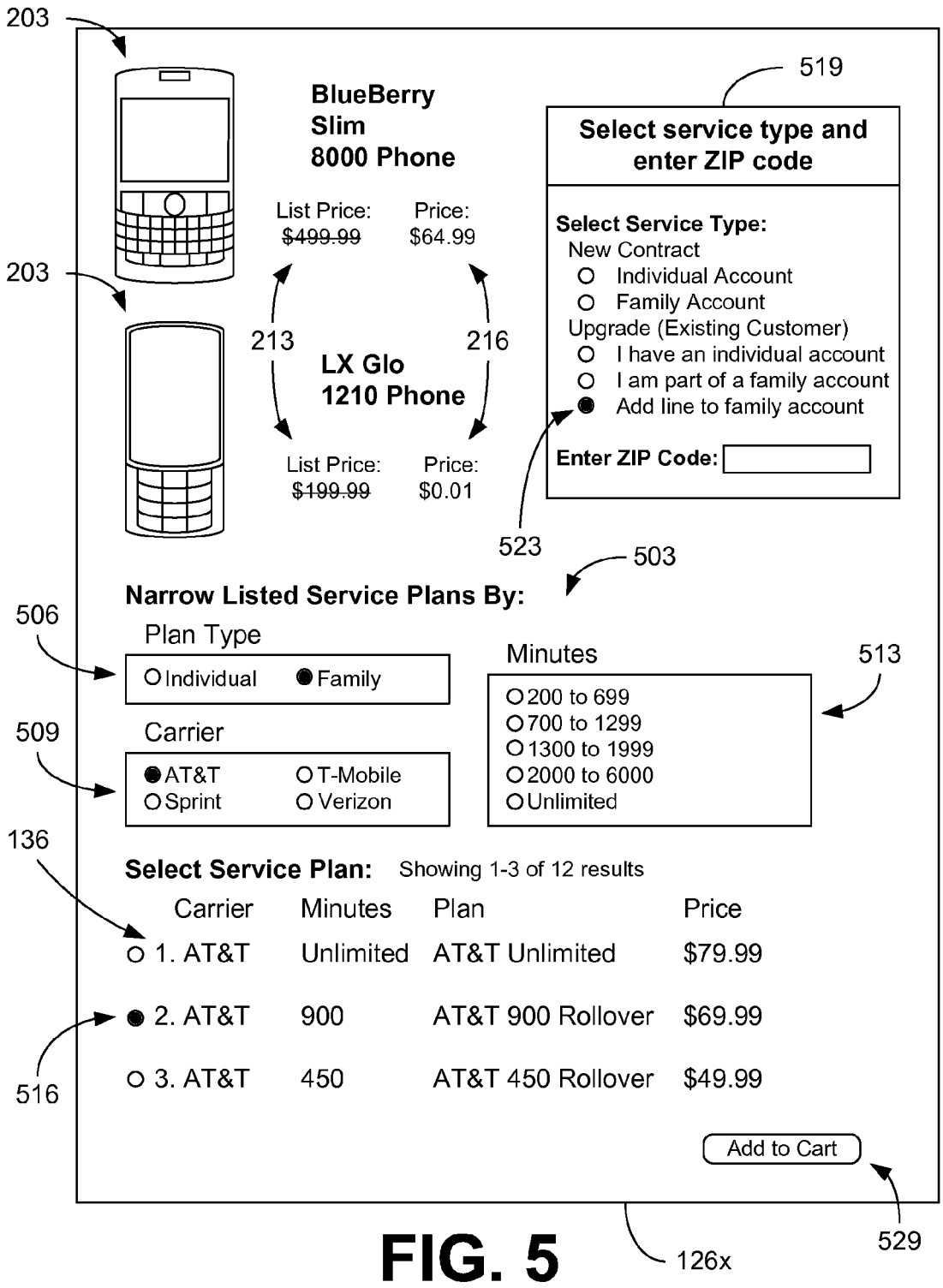

In some embodiments, a single network page 126*x* may allow selection of the service type and the service plan. FIG. 5 illustrates an example of a network page 126*x* generated by the electronic commerce system 119 (FIG. 1) in response to the selection of one or more wireless devices 123 (FIG. 1) by the customer (or client). In the exemplary embodiment of FIG. 5, the network page 126*x* may include various information regarding the selected wireless device(s) 123 such as, but not limited to, a picture of the device(s) 203, availability information, product description and key features, and a list price 213 for each device 123. To provide information to a potential customer, the network page 126*x* also includes a price 216 that is offered by the electronic commerce system 119 for the selected wireless device(s) 123.

In the example of FIG. 5, the customer selects a service type through component 519 of network page 126*x*. For example, if the customer has an existing wireless contract, the customer may select an option under "Existing Customer" such as adding another line as illustrated by selection 523 of FIG. 5. Selection of a service type by the customer may cause one or more of the corresponding prices to be updated as described above. Component 519 of network page 126*x* may also obtain information corresponding to a service area associated with the service contract such as, but not limited to, a postal code (e.g., a zip code), an area code, or an existing telephone number. Specifying an area designation may affect the pricing of some or all of the wireless device(s) 123. In some cases, one or more wireless devices may be eliminated from the network page 126 because service plans 136 (FIG. 1) are not available in the identified area.

The updated price is then provided to the client device 106 (FIG. 1) by the dynamic pricing application 129 of the electronic commerce system 119. In one embodiment, the updated price is provided to a browser application 143 (FIG.

1) to update the network page 126*x*. In another embodiment, a new network page including the updated price is provided to the client device 106 for rendering. In some embodiments, the selected service type may not affect the price(s) 216 of the wireless device(s) 123, causing one or more price(s) to remain the same.

In the embodiment of FIG. 5, a service plan 136 may also be selected through network page 126*x*. Network page 126*x* includes a component 503 that facilitates selection of a service plan 136 associated with the selected wireless device(s) 123. Selection of a service plan 136 by the customer (e.g., as indicated by 516) may cause one or more of the corresponding price(s) 216 to be further updated as described above. In some embodiments, all available service plans 136 are presented in the network page. Alternatively, the service plans 136 may be filtered or restricted to reduce the number of presented service plans 136. For example, in the exemplary embodiment of FIG. 5, component 503 includes display options to limit the presented service plans 136 by plan type 506, service carrier 509, and/or plan minutes 513. As can be understood, other display options may be used as appropriate.

The customer may then proceed with the purchasing process by requesting that the selected wireless device(s) 123 and service plan be added to a shopping cart using icon 529. In some embodiments including a plurality of selected wireless devices 123, the customer may select one or more specific wireless device(s) 123 to be added to the cart.

In response to the request of the customer, the electronic commerce system 119 (FIG. 1) generates another network page 126 for selection of service options associated with the selected wireless device 123 and the selected service plan 136. FIG. 6 provides an example of a network page 126*d* generated by the electronic commerce system 119 in response to the request by the customer (or client). In the exemplary embodiment of FIG. 6, the service option network page 126*d* includes a further updated price 603 for the selected wireless device that was readjusted based upon the selected wireless device 123 (FIG. 1), the selected service type, and/or the selected service plan 136 (FIG. 1).

Network page 126*d* also includes a component 606 to facilitate selection of one or more service plan options associated with the selected wireless device 123 and the selected service plan 136. A variety of options may be presented in the network page 126*d* as depicted in the non-limiting embodiment of FIG. 6. In one embodiment, the dynamic pricing application 129 readjusts the price of the selected wireless device 123 as options are selected. In some embodiments, the price of the selected wireless device 123 is readjusted if the total cost of the selected options exceeds a predefined limit (or is within a predefined tier). In another embodiment, the price of the selected wireless device 123 is updated after the selected service option(s) is/are added to the cart using icon 609. When the customer requests that the service options be added to the shopping cart, a summary network page 126 may be generated by the electronic commerce system 119 and provided to the client device 106 for rendering. The summary network page 126 includes final pricing for the selected wireless device 123, selected service plan 136, and any selected options added to the shopping cart.

While the examples of FIGS. 2-5 produce an outstanding cost for the selected wireless device 123, in some embodiments negative adjustments to the price may exceed the price of the selected wireless device 123. For example, if the dynamic pricing application 129 determines that the selected service plan 136 and service options provide a negative price adjustment of $85.00; this would exceed the cost of a $79.99 wireless device. In some embodiments, the updated price for the selected wireless device 123 would be limited to a nominal amount (e.g., $0.01) or to no cost (i.e., $0.00). Alternatively, the electronic commerce system 119 may offer a credit in the amount of the excess adjustment (or discount) for additional purchases through the electronic commerce system 119. For instance, in the above example, a credit for $5.01 may be applied to the customer account 139 to be used for purchases of other items through the electronic commerce system 119. In some embodiments, the credit may be limited to the purchase of items associated with the selected wireless device 123 such as, but not limited to, applications, ring tones, or digital music that may be downloaded and used on the selected wireless device 123.

Referring next to FIGS. 7A-7D, shown are flowcharts 700 and 780 that provide an example of the operation of a portion of a dynamic pricing system according to various embodiments. It is understood that the flowcharts 700 and 780 of FIGS. 7A-7D provide merely an example of the many different types of functional arrangements that may be employed to implement the operation of the depicted functionality of the dynamic pricing system as described herein. As an alternative, the flowcharts 700 and 780 of FIGS. 7A-7D may be viewed as depicting an example of steps of a method implemented in the computing device 103 (FIG. 1) according to one or more embodiments.

Figure 7A:
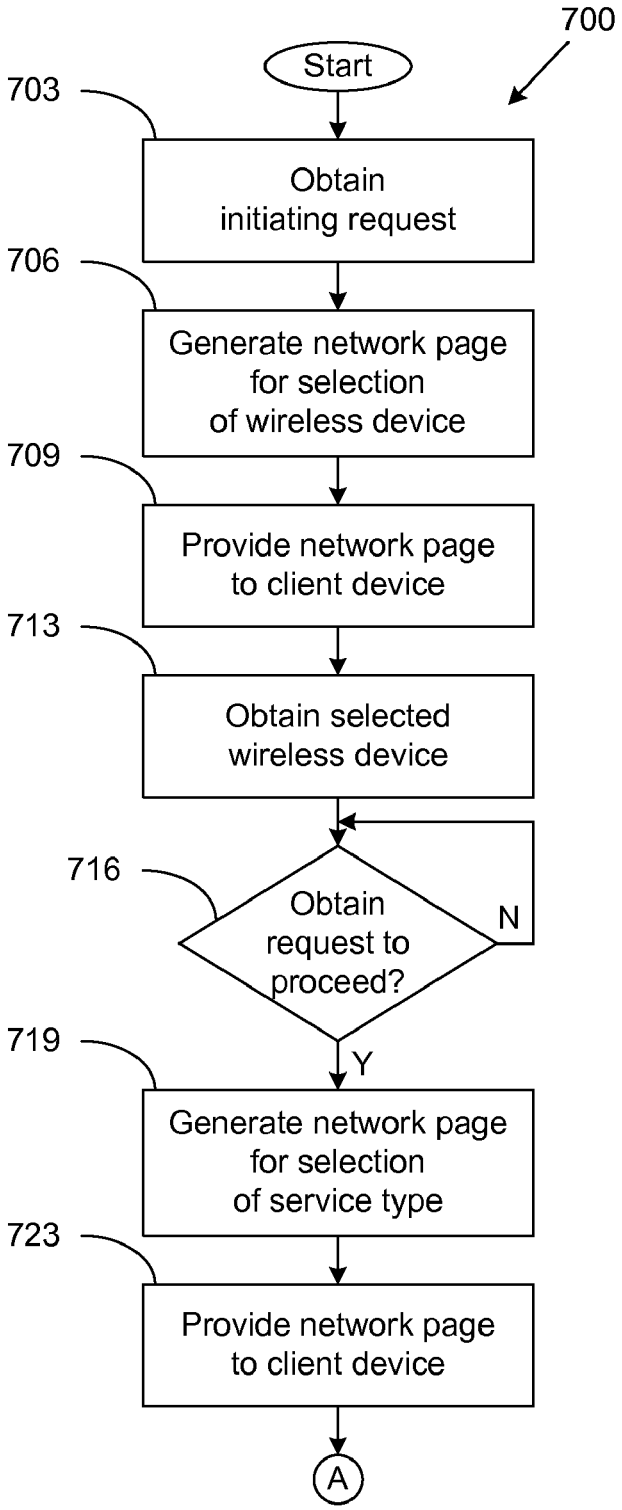
FIGS. 7A-7D are flowcharts illustrating one example of functionality implemented as portions of a dynamic pricing system executed in at least one computing device in the networked environment of FIG. 1 according to various embodiments of the present disclosure.

Beginning with block 703 of FIG. 7A, an initiating request is obtained by an electronic commerce system 119 (FIG. 1) from a client device 106 over a network 113 (FIG. 1). The initiating request may be in the form of, but is not limited to, a request to access a network page 126 of the electronic commerce system 119. In response to the initiating request, the electronic commerce system 119 generates a preliminary network page 126 for selection of a wireless device 123 (FIG. 1) in block 706. The preliminary network page 126 includes a component that facilitates selection, by a customer, of a wireless device 123 that is available through the electronic commerce system 119. The network page 126 is then provided to the client device 106 in block 709 for rendering. The customer may then utilize the component in the network page 126 to select a desired wireless device 123.

In block 713, the electronic commerce system 119 obtains the selected wireless device 123 from the client device 106. In some embodiments, multiple wireless devices 123 may be selected. When the selection is complete, the customer may provide an indication or request to proceed. For example, the customer may confirm that the selection is complete by selecting a designated icon on the network page 126. If a request to proceed is obtained in block 716, then the electronic commerce system 119 generates a network page 126 for selection of a service type associated with the selected wireless device 123 in block 719. The service type network page (e.g., network page 126*a* of FIG. 1) includes a price for the selected wireless device 123 and a component that facilitates selection of a service type associated with the selected wireless device 123. In block 723, the service type network page 126 is provided to the client device 106 (FIG. 1) for rendering. The customer may then select a service type utilizing the component of the service type network page 126. Alternatively, a service type may be determined, for example, by the electronic commerce system 119 based upon customer account 139 information or by a browser application 143 (FIG. 1) based upon customer information stored on the client device 106.

Figure 7B:
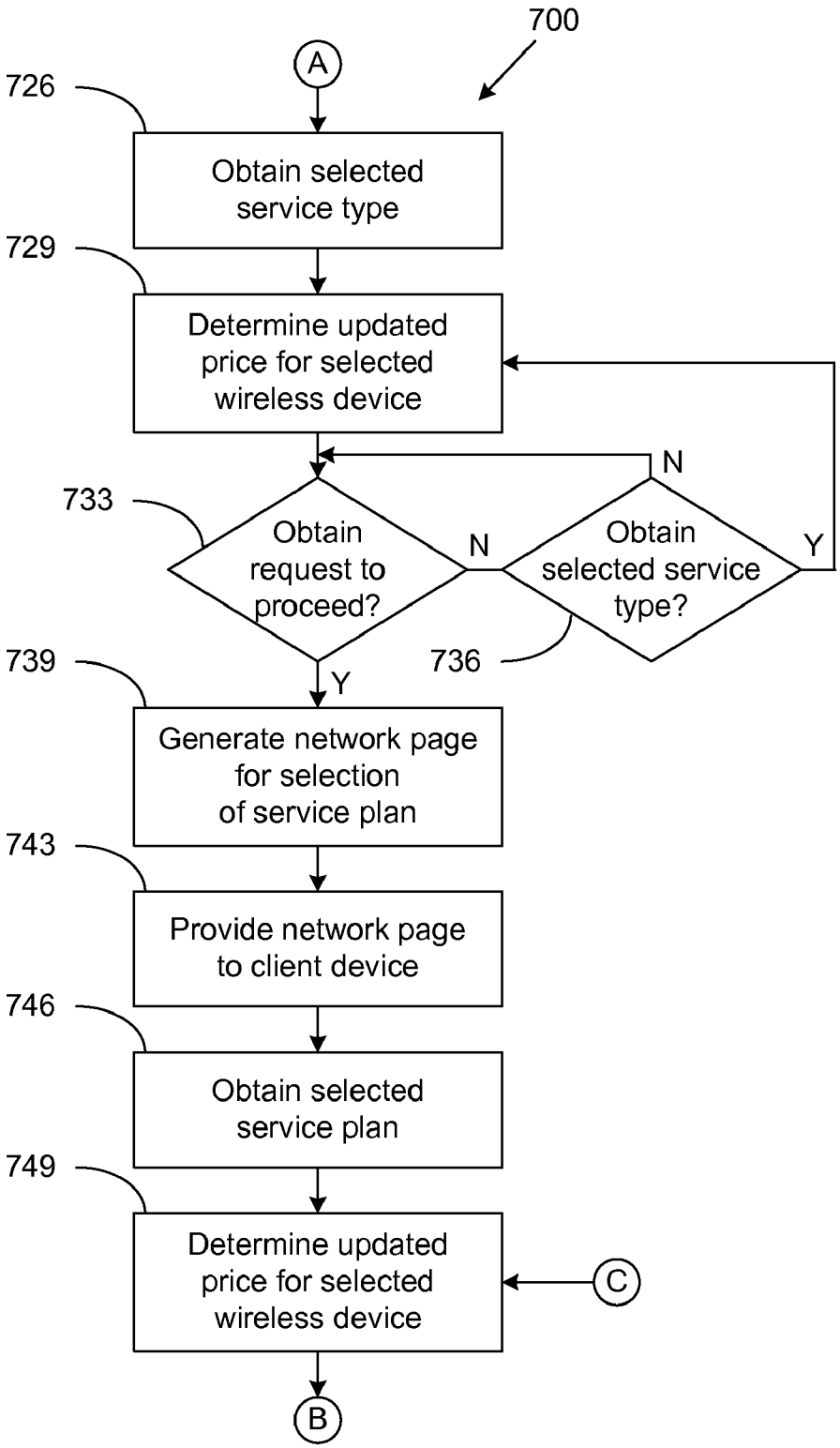

Referring next to FIG. 7B, a selected service type is obtained by the electronic commerce system 119 in block 726. An updated price for the selected wireless device 123 is then determined by the dynamic pricing application 129 based upon the selected wireless device 123 and the selected service type in block 729 as previously described. The updated price is then provided to the client device 106 for customer access. In some embodiments, the updated price is provided and the service type network page 126 is revised with the updated price. Alternatively, a new service type network page 126 may be generated with the updated price and served up to the client device 106 for rendering.

If a request to proceed is not obtained in block 733, then in block 736 it is determined if another service type has been selected. If another selected service type has been obtained, then another updated price is determined in block 729 based upon the selected wireless device 123 and the newly selected service type and provided to the client device 106. This process may repeat until a request to proceed is obtained in block 733. For example, the customer may indicate, through a service type network page 126*b* (FIG. 3), that the selected wireless device 123 and service type be added to a shopping cart by selecting icon 229.

Once a request to proceed is obtained in block 733, the electronic commerce system 119 generates a network page 126 for selection of a service plan 136 associated with the selected wireless device 123 in block 739. The service plan network page 126 includes the updated price for the selected wireless device 123 and a component that facilitates selection of the service plan 136. The network page is provided to the client device 106 for rendering in block 743. The customer may then use the component of the service plan network page 126 (e.g., component 403 of network page 126*c* of FIG. 4) to select the service plan 136.

The selected service plan 136 is obtained by the electronic commerce system 119 in block 746. A revised updated price for the selected wireless device 123 is then determined by the dynamic pricing application 129 in block 749. The updated price may be revised or adjusted based, for example, upon the selected wireless device 123, the selected service type, and/or the selected service plan 136. The newly updated price is provided to the client device 106 for customer access.

Figure 7C:
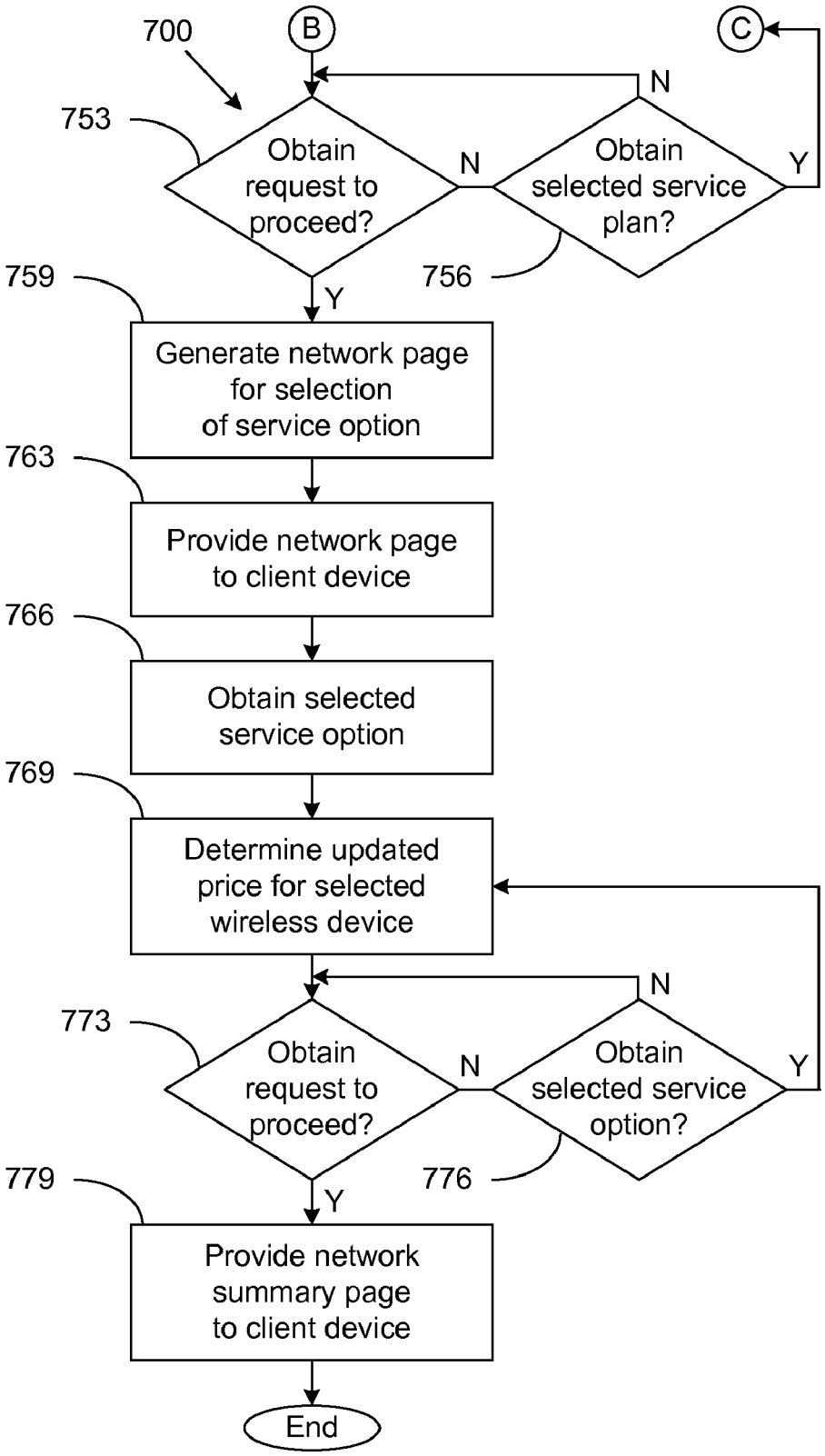

If a request to proceed is not obtained in block 753 of FIG. 7C, then in block 756 it is determined if another service plan 136 has been selected. If another selected service plan 136 has been obtained, then another updated price is determined in block 749 (FIG. 7B) based, for example, upon the selected wireless device 123, the selected service type, and/or the newly selected service plan 136 and provided to the client device 106. This process may repeat until a request to proceed is obtained in block 753 of FIG. 7C. For example, the customer may indicate, through one of the icons 416 of a service plan network page 126*c* (FIG. 4), that the selected service plan 136 be added to the shopping cart with the selected wireless device 123.

When the request to proceed is obtained in block 753 of FIG. 7C, the electronic commerce system 119 generates a network page 126 for selection of a service plan option associated with the selected wireless device 123 in block 759. The service option network page 126 includes the further updated price for the selected wireless device 123 that was readjusted based upon selection of a service plan 136. The service option network page 126 also includes a component that facilitates selection of one or more service options associated with the selected service plan and selected wireless device (e.g., component 606 of network page 126*d* of FIG. 6). The network page 126 is provided to the client device 106 for rendering in block 763. The customer may then use the component of the service plan network page 126 to select the service option(s).

One or more selected service option is obtained by the electronic commerce system 119 in block 766. An updated price for the selected wireless device 123 may then determined by the dynamic pricing application 129 by adjusting the price of the selected wireless device 123 based upon the selected service option(s) in block 769. The adjusted price is then provided to the client device 106 for customer access. In some embodiments, the updated price may not be adjusted until the cost of the selected service options exceeds a predefined threshold.

If a request to proceed is not obtained in block 773, then in block 776 it is determined if another service option has been selected or if one of the selected service options has be removed or changed. If a change in selected service options has been obtained, then another updated price is determined in block 769 by further adjustment based, for example, upon the selected wireless device 123, the selected service plan 136, and/or the selected service options and provided to the client device 106. This process may repeat until a request to proceed is obtained in block 773. For example, the customer may indicate, through the component 606 of a service option network page 126*d* (FIG. 6), that the selected service options be added to the shopping cart by selecting icon 609. Once a request to proceed is obtained in block 733, the electronic commerce system 119 generates a network page 126 to summarize the selections of the customer and provides it to the client device 106 for rendering in block 779.

Figure 7D:
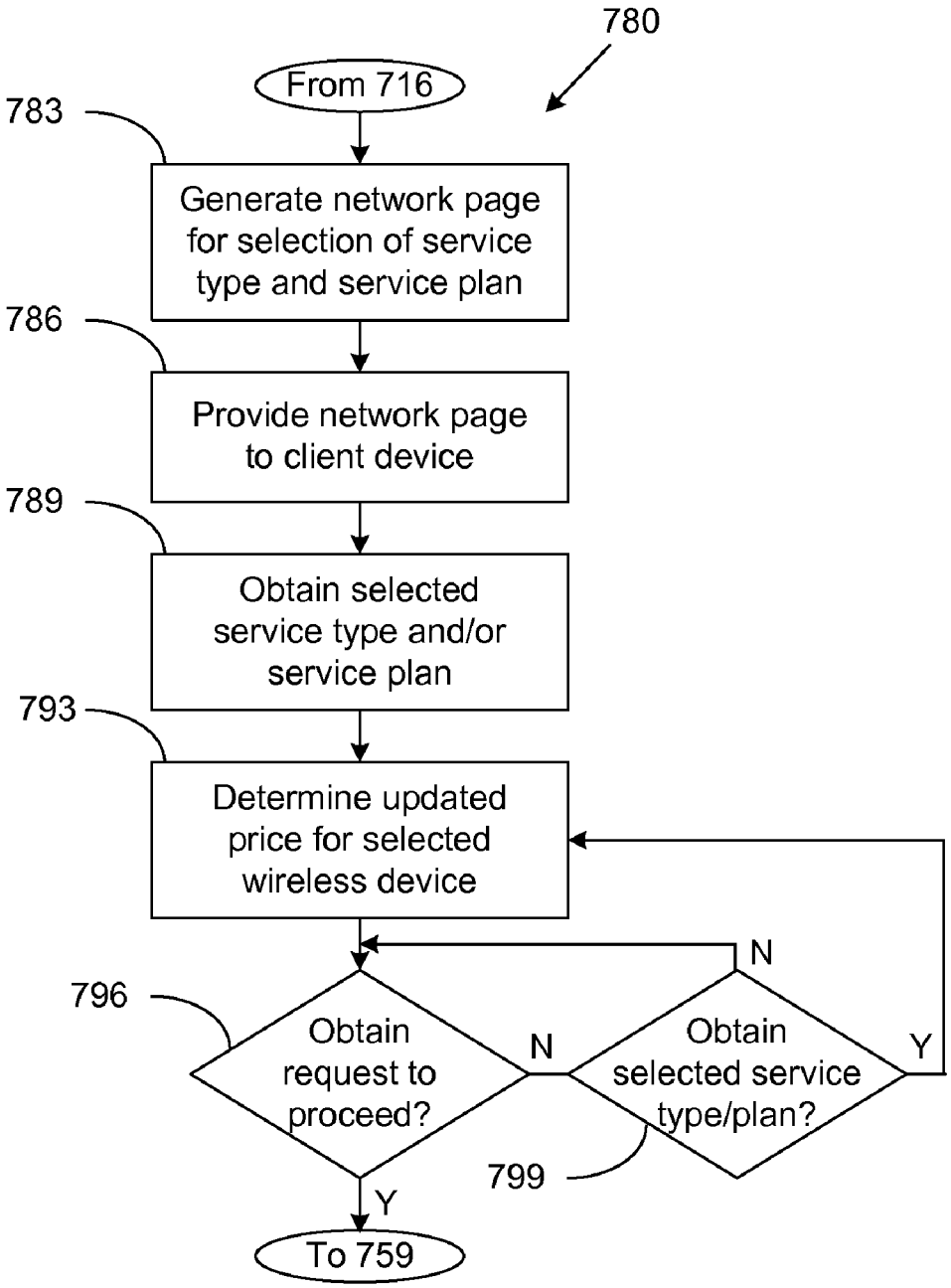

In some embodiments, a single network page 126*x* may allow selection of the service type and the service plan. FIG. 7D illustrates a flowchart 780 depicting the operation of a portion of the dynamic pricing system according to various embodiments. For example, blocks 719-756 may be replaced by the blocks of flowchart 780. From block 716 of FIG. 7A, if a request to proceed is obtained, then the electronic commerce system 119 may generate a network page 126 for selection of a service type and/or service plan associated with the selected wireless device 123 in block 783. The network page (e.g., network page 216*x* of FIG. 5) includes a price for the selected wireless device 123 and components that facilitate selection of a service type and a service plan associated with the selected wireless device 123. In block 786, the network page 126 is provided to the client device 106 (FIG. 1) for rendering. The customer may then select a service type and/or a service plan utilizing the components of the service type network page 126.

The selected service type and/or service plan is obtained by the electronic commerce system 119 in block 789. An updated price for the selected wireless device 123 is then determined by the dynamic pricing application 129 based upon the selected wireless device 123 and the selected service type and/or service plan in block 793 as previously described. The updated price is then provided to the client device 106 for customer access. In some embodiments, the updated price is provided and the network page 126 is revised with the updated price. Alternatively, a new network page 126 may be generated with the updated price and served up to the client device 106 for rendering.

If a request to proceed is not obtained in block 796, then in block 799 it is determined if another service type and/or service plan has been selected. If another selected service type and/or service plan has been obtained, then another updated price is determined in block 793 based upon the selected wireless device 123 and the currently selected service type and/or service plan and provided to the client device 106. This process may repeat until a request to proceed is obtained in block 796. For example, the customer may indicate, through a network page 126×(FIG. 5), that the selected wireless device 123 and service type and/or service plan be added to a shopping cart by selecting icon 529.

When the request to proceed is obtained in block 796, the electronic commerce system 119 may generate a network page 126 for selection of a service plan option associated with the selected wireless device 123 in block 759 of FIG. 7C. In some embodiments, the dynamic pricing system may not proceed to block 759 unless both a service type and a service plan have been selected. In that case, the dynamic pricing system may provide an indication that the remaining item (service type or service plan) has not been selected for rendering by the client device 106. In other embodiments, the dynamic pricing system may proceed to block 759 if at least a service plan has been selected.

As discussed above, the service option network page 126 includes the further updated price for the selected wireless device 123 that was readjusted based upon selection of a service plan 136 and/or a service type. The service option network page 126 also includes a component that facilitates selection of one or more service options associated with the selected service plan and selected wireless device (e.g., component 606 of network page 126*d* of FIG. 6). The dynamic pricing system may then proceed through the remaining blocks of FIG. 7C as described above.

Figure 8:
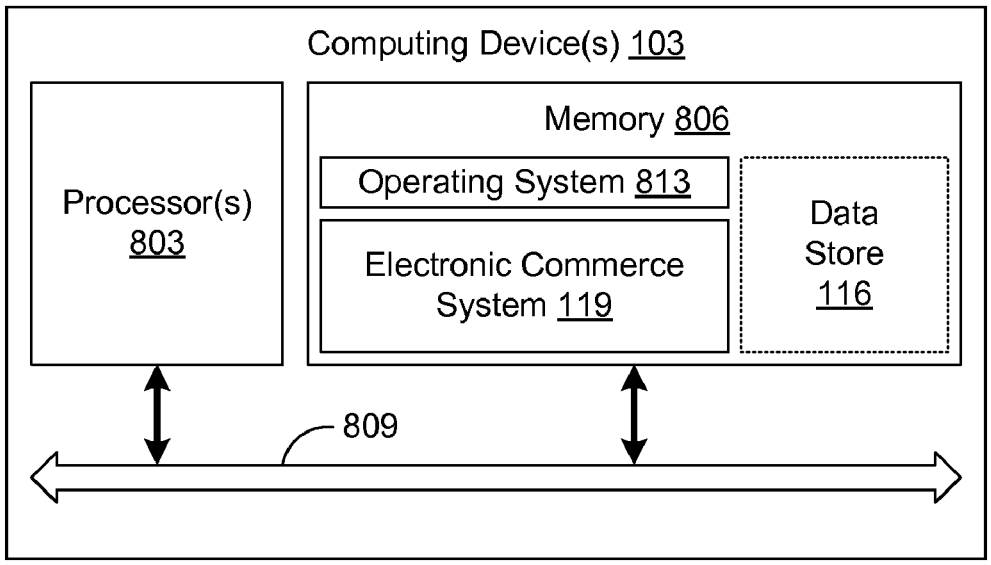
FIG. 8 is a schematic block diagram that provides one example illustration of a computing device employed in the networked environment of FIG. 1 according to various embodiments of the present disclosure.

With reference to FIG. 8, shown is a schematic block diagram of the computing device 103 according to an embodiment of the present disclosure. The computing device 103 includes at least one processor circuit, for example, having a processor 803 and a memory 806, both of which are coupled to a local interface 809. To this end, the computing device 103 may comprise, for example, at least one server computer or like device. The local interface 809 may comprise, for example, a data bus with an accompanying address/control bus or other bus structure as can be appreciated.

Stored in the memory 806 are both data and several components that are executable by the processor 803. In particular, stored in the memory 806 and executable by the processor 803 are the electronic commerce system 119, including the dynamic pricing application 129 (FIG. 1), and potentially other applications. Also stored in the memory 806 may be a data store 116 and other data. In addition, an operating system 813 may be stored in the memory 806 and executable by the processor 803.

It is understood that there may be other applications that are stored in the memory 806 and are executable by the processors 803 as can be appreciated. Where any component discussed herein is implemented in the form of software, any one of a number of programming languages may be employed such as, for example, C, C++, C#, Objective C, Java, Java Script, Perl, PHP, Visual Basic, Python, Ruby, Delphi, Flash, or other programming languages.

A number of software components are stored in the memory 806 and are executable by the processor 803. In this respect, the term "executable" means a program file that is in a form that can ultimately be run by the processor 803. Examples of executable programs may be, for example, a compiled program that can be translated into machine code in a format that can be loaded into a random access portion of the memory 806 and run by the processor 803, source code that may be expressed in proper format such as object code that is capable of being loaded into a random access portion of the memory 806 and executed by the processor 803, or source code that may be interpreted by another executable program to generate instructions in a random access portion of the memory 806 to be executed by the processor 803, etc. An executable program may be stored in any portion or component of the memory 806 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 806 is defined herein as including both volatile and nonvolatile memory and data storage components. Volatile components are those that do not retain data values upon loss of power. Nonvolatile components are those that retain data upon a loss of power. Thus, the memory 806 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 803 may represent multiple processors 803 and the memory 806 may represent multiple memories 806 that operate in parallel processing circuits, respectively. In such a case, the local interface 809 may be an appropriate network that facilitates communication between any two of the multiple processors 803, between any processor 803 and any of the memories 806, or between any two of the memories 806, etc. The local interface 809 may comprise additional systems designed to coordinate this communication, including, for example, performing load balancing. The processor 803 may be of electrical or of some other available construction.

Although the electronic commerce system 119, and more specifically, the dynamic pricing application 129, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts 700 of FIGS. 7A-7D show the functionality and operation of an implementation of portions of a dynamic pricing system including the dynamic pricing application 129. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 803 in a computer system or other system. The machine code may be converted from the source code, etc. If embodied in hardware, each block may represent a circuit or a number of interconnected circuits to implement the specified logical function(s).

Although the flowcharts 700 of FIGS. 7A-7D show a specific order of execution, it is understood that the order of execution may differ from that which is depicted. For example, the order of execution of two or more blocks may be scrambled relative to the order shown. Also, two or more blocks shown in succession in FIGS. 7A-7D may be executed concurrently or with partial concurrence. Further, in some embodiments, one or more of the blocks shown in FIGS. 7A-7D may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the electronic commerce system 119, and more specifically, the dynamic pricing application 129, that comprises software or code can be embodied in any non-transitory computer-readable medium for use by or in connection with an instruction execution system such as, for example, a processor 803 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A non-transitory computer-readable medium embodying a program executable in a computing device, the program comprising:

code that generates a first network page in response to selection of a cellular telephone by a client, the first network page including a price for the cellular telephone and a first component that facilitates selection of a service type associated with the cellular telephone;

code that updates the price for the cellular telephone included in the first network page in response to selection of the service type by the client;

code that generates a second network page in response to a request from the client, the second network page including a second component that facilitates selection of a service plan associated with the cellular telephone and the selected service type, the service plan provided by a wireless service provider; and code that further updates the price for the cellular telephone in response to selection of the service plan by the client;

wherein the program updates the price for the cellular telephone based at least in part upon a base price for the cellular telephone and a price adder obtained from a lookup table, the price adder associated with the cellular telephone and the selected service type.

2. The computer-readable medium of claim 1, wherein the program further comprises code that generates a preliminary network page in response to an initiating request from the client, the preliminary network page including a third component that facilitates selection of the cellular telephone.

3. The computer-readable medium of claim 2, wherein the program further comprises:

code that generates a fourth network page in response to a third request from the client, the fourth network page including a fourth component that facilitates selection of a service plan option associated with the cellular telephone and the selected service plan; and code that further updates the price for the cellular telephone in response to selection of the service plan option.

4. A system, comprising:

at least one computing device; and a dynamic pricing system executable in the at least one computing device, the dynamic pricing system comprising:

logic that generates a network page to send to a client device over a network, the network page including a price for a specified wireless device;

logic that communicates with the client device over the network to obtain a selected service plan associated with the specified wireless device; and logic that determines an updated price for the specified wireless device in response to the selected service plan;

wherein the updated price is based at least in part upon a base price associated with the specified wireless device and an adjustment value associated with the selected service plan.

5. The system of claim 4, wherein the specified wireless device is a personal digital assistant (PDA).

6. The system of claim 4, wherein the service plan is a new service plan provided by a wireless service provider.

7. The system of claim 6, wherein the dynamic pricing system further comprises logic that generates a second network page to send to the client device over the network, the second network page including at least one service plan option associated with the specified wireless device and the new service plan.

8. The system of claim 7, wherein the dynamic pricing system further comprises:

logic that communicates with the client device over the network to obtain a selected service plan option; and logic that determines a second updated price for the specified wireless device in response to the selected service plan option.

9. The system of claim 4, wherein the adjustment value is a predetermined value corresponding to the selected service plan.

10. The system of claim 9, wherein the predetermined value is a percentage of a total value of the selected service plan.

11. The system of claim 4, wherein the adjustment value is a negative adjustment value.

12. A method, comprising the steps of:

providing, by at least one computing device, a network page over a network to a client device, the network page including a price for a wireless device and a component that facilitates selection of a service type;

obtaining, by the at least one computing device, a selected service type associated with the wireless device from the client device;

providing, by the at least one computing device, an updated price for the wireless device to the client device, the updated price based at least in part upon the wireless device and the selected service type;

wherein providing an updated price comprises providing a second network page including the updated price, the second network page including a second component that facilitates selection of a service plan associated with the wireless device and the selected service type; and, wherein the updated price is based at least in part upon a base price associated with the specified wireless device and an adjustment value associated with the selected service plan.

13. The method of claim 12, wherein the service plan is based at least in part upon a postal code associated with the wireless device.

14. The method of claim 12, further comprising:

obtaining, by the at least one computing device, a selected service plan from the client device; and providing, by the at least one computing device, a further updated price for the wireless device to the client device, the updated price based at least in part upon the wireless device, the selected service type, and the selected service plan.

15. The method of claim 12, wherein the network page comprises a plurality of wireless devices and a plurality of prices, each of the plurality of prices corresponding to a respective one of the plurality of wireless devices, and at least one of the plurality of wireless devices being associated with the selected service type.

16. The method of claim 15, further comprising providing to the client device, by the at least one computing device, an updated price for each of the plurality of wireless devices associated with the selected service type, the updated prices based at least in part upon the associated wireless device and the selected service type.

* * * * *